US007591469B2

(12) United States Patent
Dowe

(10) Patent No.: US 7,591,469 B2
(45) Date of Patent: Sep. 22, 2009

(54) DIAGRAMLESS CROSSWORD PUZZLE HELPER

(76) Inventor: Robert Dowe, 16225 Erin, Fraser, MI (US) 48026

( * ) Notice: Subject to any disclaimer, the term of this patent is extended or adjusted under 35 U.S.C. 154(b) by 88 days.

(21) Appl. No.: 10/591,039

(22) PCT Filed: Mar. 8, 2005

(86) PCT No.: PCT/US2005/007557

§ 371 (c)(1),
(2), (4) Date: Aug. 29, 2006

(87) PCT Pub. No.: WO2005/087333

PCT Pub. Date: Sep. 22, 2005

(65) Prior Publication Data

US 2007/0182097 A1 Aug. 9, 2007

(51) Int. Cl.
*A63F 3/00* (2006.01)

(52) U.S. Cl. ..... 273/272; 434/177

(58) Field of Classification Search ..... 273/272, 273/153 R, 286, 287; 434/177, 17
See application file for complete search history.

(56) References Cited

U.S. PATENT DOCUMENTS 4,244,580 A * 1/1981 Hoyles ..... 273/272
4,299,578 A * 11/1981 Wayman ..... 434/177
4,625,971 A * 12/1986 Ferguson ..... 273/272
5,566,942 A * 10/1996 Elum ..... 273/153 R
6,378,867 B1 * 4/2002 Shalless ..... 273/240
6,460,854 B1 * 10/2002 McCarey ..... 273/272
6,491,300 B2 * 12/2002 Harris et al. ..... 273/272
6,585,585 B1 * 7/2003 Fletcher ..... 463/9
7,000,919 B2 * 2/2006 LiDonnici ..... 273/272
7,216,868 B2 * 5/2007 Groz et al. ..... 273/272
7,275,746 B2 * 10/2007 Jensen ..... 273/272
2004/0183253 A1 * 9/2004 LiDonnici P.E. ..... 273/272

OTHER PUBLICATIONS

International Search Report and Written Opinion dated Jun. 8, 2005.
Amende, Coral, "The Crossword Obsession", Glossary, Copyright 2001, p. 345, Published by The Berkley Publishing Group. New York, New York.
Kurzban, Stan and Rosen, Mel. "The Compleat Cruciverbalist", Article, Copyright 1981, Chapter 6 pp. 53-59, Chapter 8, pp. 71, 80-81, and Chapter 11, pp. 134-136. Published by Van Nostrand Reinhold Company. New York, New York.
Excerpt from The Detroit News, dated Jun. 13, 2001.
Miller, Mike, "Beyond Crossword Puzzles," Prentice-Hall, Inc., Englewood Cliffs, New Jersey 07632.

* cited by examiner

*Primary Examiner*—William M Pierce
(74) *Attorney, Agent, or Firm*—Carlson & Gaskey & Olds PC

(57) ABSTRACT

A word puzzle game includes a grid (20) of blank answer spaces displayed on a gaming surface. The grid (20) includes a reference mark (32) that visually assists a user of the word puzzle game. The reference mark (32) associates a first answer space to a symmetric location of a second answer space in the grid of blank answer spaces. One example method of determining a location of symmetrically located space includes determining a location of a first space in the grid of blank answer spaces, associating the location of the first space with space with the reference mark, and determining a location in the grid (20) of the symmetrically located spaces based upon the association of the location of the first space with the reference mark.

6 Claims, 6 Drawing Sheets

DIAGRAMLESS CROSSWORD PUZZLE HELPER

BACKGROUND OF THE INVENTION

This invention relates to crossword puzzles and, more particularly, to a crossword puzzle grid having a reference mark, symmetric coordinates, or both to facilitate solving or composing a word puzzle game.

Standard American crossword puzzles include a grid and puzzle clues. The grid may vary in size, usually 9×9 squares up to 25×25 squares. The difficulty of the crossword puzzle typically increases with increasing number of squares. The grid typically includes numbered squares that each designate where the puzzle-solver is to begin entering a particular answer to a puzzle clue and one or more black squares between answers.

One challenging crossword puzzle variation utilizes a "diagramless" grid. A "diagramless" grid does not include numbers to indicate to a puzzle-solver where to begin entering each answer, nor does the "diagramless" grid include the black squares. Instead, the puzzle-solver determines the answers, the number of squares required for the answer, the location of the answers, and the location of each separator between answers. A "diagramless" crossword puzzle is considerably more difficult than a standard American puzzle because of the added complexity of determining the locations of the answers and spacer squares in the grid.

Accordingly, a grid having a reference mark that visually aids the puzzle-solver in identifying locations in the grid is needed. This invention addresses those needs and provides enhanced capabilities while avoiding the shortcomings and drawbacks of the prior art.

SUMMARY OF THE INVENTION

A word puzzle game includes a grid of blank answer spaces for entering a first answer to a first puzzle clue in a first space and a second answer to a second puzzle clue in a second space. A reference mark for visually aiding a user of the word puzzle game relates the first space to the second space.

In one example, the reference mark includes a colored symmetric pattern that is rotationally symmetric about a midpoint of the grid of blank answer spaces. The symmetric pattern includes colored shapes that are rotationally symmetric with respect to the central axis.

In another example, the reference mark includes symmetric coordinates for identifying grid locations within the grid of blank answer spaces. The coordinates of symmetric answer spaces are equal to each other to provide a visual relationship between the symmetrically located answer spaces.

One example method of determining a location of symmetrically located space on a crossword puzzle game board includes establishing a location of a first space in a grid of blank answer spaces, associating the location of the first space with a reference mark, and determining a location in the grid of the symmetrically located space based upon the association of the location of the first space with the reference mark.

BRIEF DESCRIPTION OF THE DRAWINGS

The various features and advantages of this invention will become apparent to those skilled in the art from the following detailed description of the currently preferred embodiment. The drawing that accompanies the detailed description can be briefly described as follows.

DETAILED DESCRIPTION OF THE PREFERRED EMBODIMENTS

Figure 1:
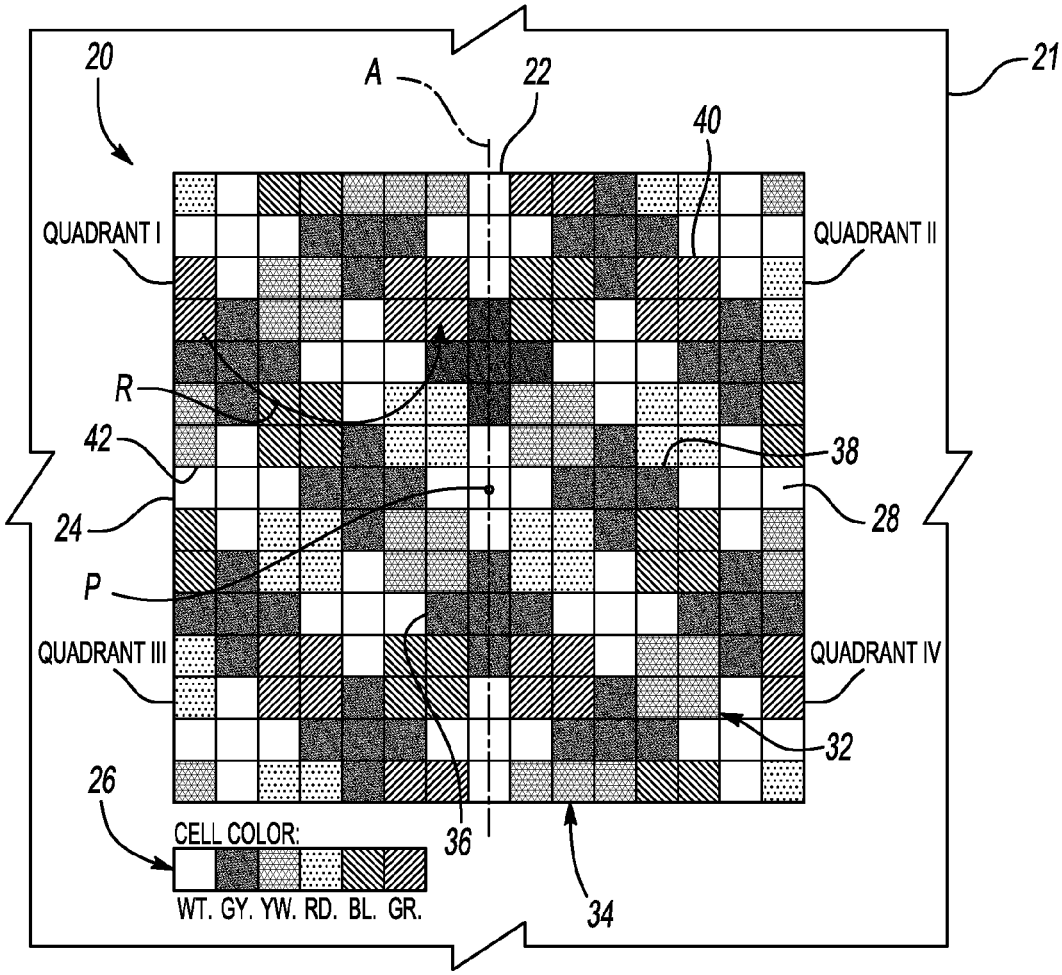
FIG. 1 illustrates a schematic view of an example word puzzle grid having a reference mark.

FIG. 1 illustrates an example word puzzle game grid 20 displayed on a gaming surface 21, such as a game board in a newspaper, a puzzle book, an electronic screen, an erasable surface, inlaid surface, or other gaming surface. The example grid 20 is of the "diagramless" variety. The term "diagramless" as used in this disclosure refers to a type of word puzzle and method for playing the word puzzle, as will be described in more detail below.

In the illustrated example, the grid 20 size is 15×15 spaces (in this example, squares), although other grid sizes such as, but not limited to, 9×9 to 25×25 spaces or rectangular grids could also be used. A vertical center column 22 and a horizontal row 24 define four quadrants of the grid 20, quadrant I, quadrant II, quadrant III, and quadrant IV. A color key 26 is included with the grid 20 to distinguish color for a black and white version of the grid 20, although in full color examples the color key 26 is not needed.

In the illustrated example, the grid 20 includes blank answer spaces 28 for solving or composing a "diagramless" crossword puzzle using a set of puzzle clues. In one example, the set of puzzle clues need not be supplied with the grid 20. One advantage of the grid 20 is that it may be used (and reused if made erasable) with sets of puzzle clues from a variety of different sources, such as newspapers, magazines, or other sources for example.

A "diagramless" crossword puzzle is considerably more difficult and complex compared to a standard American crossword puzzle because a puzzle user determines the locations of the answers in the grid 20. One example strategy includes using a symmetry that is associated with the set of puzzle clues to determine the locations of answer spaces in the grid 20. Many sets of puzzle clues are known to utilize rotational symmetry for example. Rotational symmetry as used in this description refers to an object (puzzle, pattern, figure, etc.) that, if rotated 180°, looks identical to the object before it was rotated. If the puzzle user knows of this symmetry (e.g. the puzzle user is familiar with rotational symmetry and its use in crossword puzzle games), he can solve a first puzzle clue and enter the answer in a first answer space to determine the symmetric location of a second answer space of an unsolved, second puzzle clue in the grid 20.

The grid 20 includes a reference mark 32 that provides the benefit of helping the user identify rotationally symmetric locations on the grid 20. In the example shown, the reference mark 32 includes a pattern 34 within the grid 20. The pattern 34 is formed by coloring, highlighting, shading or accenting groups 36 of blank grid answer spaces 28 into crosses 38, boxes 40, and rectangles 42, for example. In the illustrated example, the pattern 34 is rotationally symmetrical such that the pattern 34 is identical to itself if rotated 180° about a midpoint P of the grid 20. That is, the groups 36 in quadrant I are identical to the pattern 34 of groups 36 in quadrant IV if quadrant I is rotated 180° with respect to a central axis A, as indicated by a direction of rotation R. Similarly, quadrant II is rotationally symmetric to quadrant III. The symmetry of the pattern 34 visually links locations of the blank grid answer spaces 28 in quadrant I to corresponding symmetric locations of blank grid answer spaces 28 in quadrant IV and locations in quadrant II to corresponding symmetric locations in quadrant III.

Figure 2:
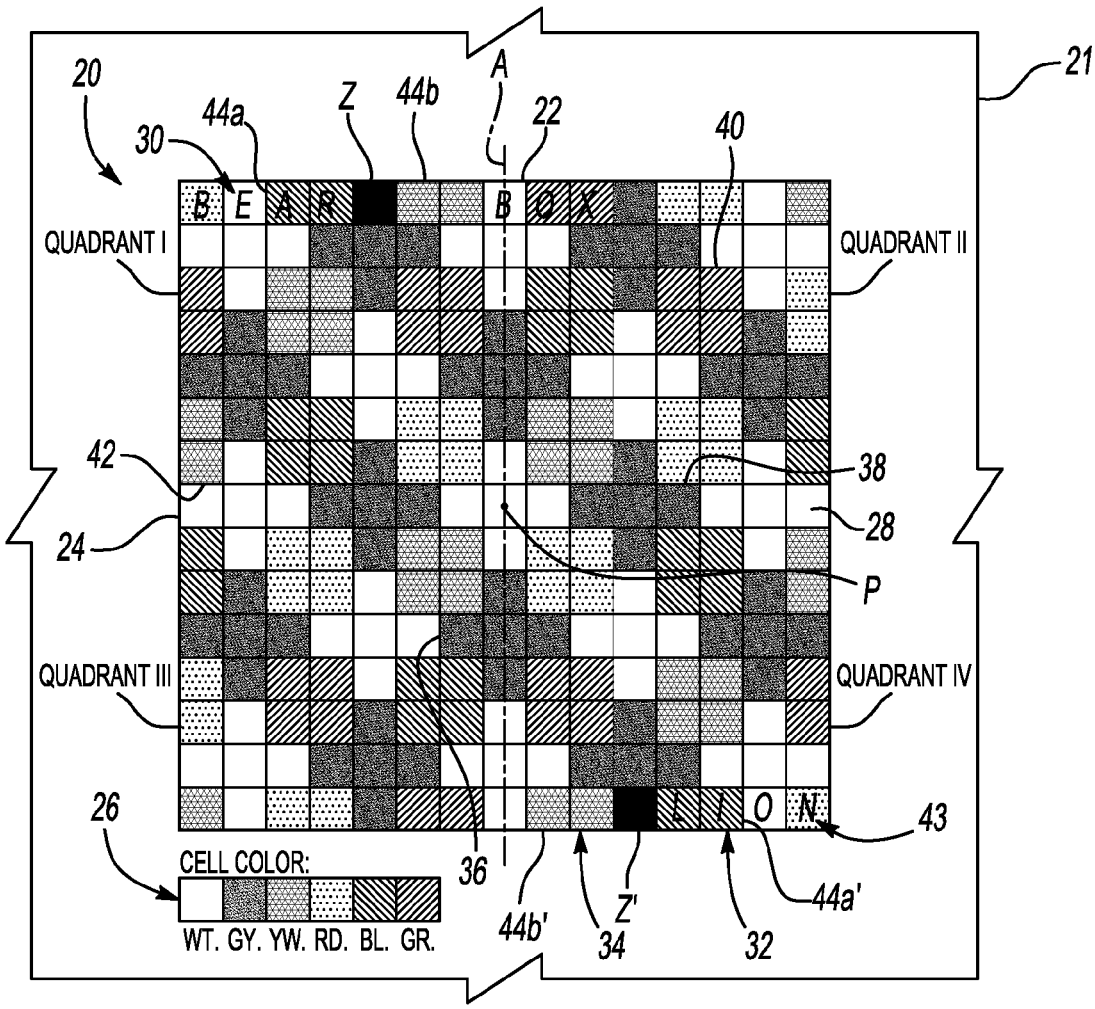
FIG. 2 illustrates a schematic view of an example strategy for solving a word puzzle game using a word puzzle grid having a reference mark.
Figure 2A:
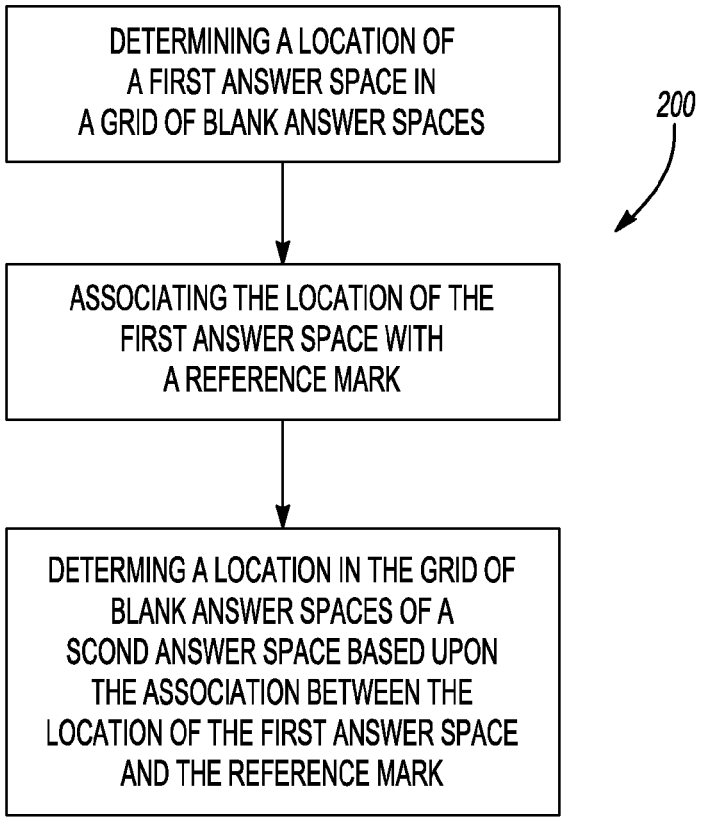
FIG. 2A illustrates an example method of determining a location of a symmetrically located space on a word puzzle game.

In one example strategy of solving a "diagramless" puzzle using rotational symmetry, a user encounters a first across puzzle clue (e.g. "Chicago football animal"). As illustrated in the example in FIG. 2 and by the method 200 illustrated in FIG. 2A, the user then determines the answer and enters the answer in a first answer space 30 at the top left of the grid 20, left to right (e.g. the word "BEAR"). In the illustrated example, the first answer space 30 includes four blank answer spaces 28. The user can be reasonably assured that this is the correct starting location for the first across clue because most sets of puzzle clues are designed to begin in this location.

Once the first across answer is entered, the user identifies a spacer Z that separates the first across answer from the next across answer, as is known for common sets of puzzle clues. In the example shown, the spacer Z is a square, however, other example sets of puzzle clues may utilize a vertical line or other type of spacer instead of a square to separate the answers. In the example shown, the user shades the spacer Z to provide visual separation between the answers.

The user now uses the pattern 34 to determine the location of a second across puzzle clue. In the illustrated example, the user has entered the answer to the first across answer clue in the first answer space 30 and has identified the spacer Z in quadrant I. The user now desires to identify a symmetric, second answer space 43. The user knows (e.g. because of his familiarity with rotational symmetry) that the second answer space 43 will be somewhere in quadrant IV. The user establishes the exact location of the spacer Z by visually associating the spacer Z with the pattern 34 in quadrant I. In one example, the user may note that the spacer Z is between a blue rectangle 44*a* and a yellow rectangle 44*b* in quadrant I. The user determines the location of a symmetric spacer Z' by looking between a blue rectangle 44*a*' and yellow rectangle 44*b*' in quadrant IV. The shapes and colors of the groups 36 in the pattern 34 provide a visual relationship between the corresponding symmetric spacers Z and Z'.

Once the user has determined the location of the symmetric spacer Z', he shades the spacer Z' to provide visual separation between answers. In the illustrated example, the second answer space 43 ends at the bottom right of the grid 20. The user may be reasonably assured that the second answer space 43 is for a last across puzzle clue of the set of puzzle clues because most crossword puzzles end in the bottom right. The user then solves the last across puzzle clue (e.g. "Jungle king") and enters the answer ("LION") in the second answer space 43. The user then proceeds to complete the puzzle in the above-described manner (i.e., by solving and entering additional puzzle clues, determining the locations of symmetrically located unsolved puzzle clues, and solving and entering the symmetrically located puzzle clues) for example.

The pattern 34 of the example reference mark 32 therefore provides the benefit of eliminating at least some confusion and complexity in locating symmetrically located answer spaces and spacers, and thus, the reference mark 32 facilitates solving or composing a word game puzzle.

Figure 3:
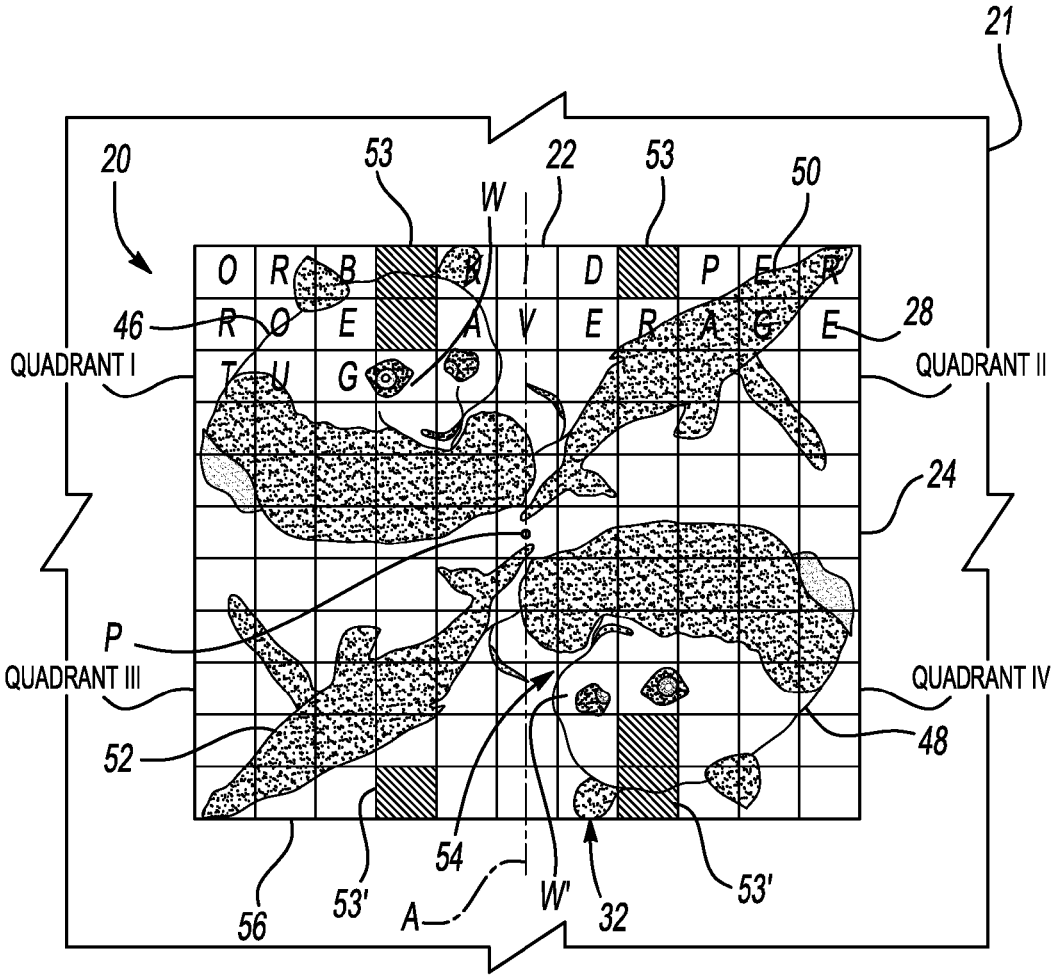
FIG. 3 illustrates a schematic view of another embodiment of an example word puzzle grid having a reference mark.

FIG. 3 shows another embodiment of the grid 20 having another example reference mark 32 that includes pictures, such as artwork, corporate logos, advertising slogans or other types of reference marks. In the illustrated example, the reference mark 32 includes pictures of a first bear 46 in quadrant I, a second bear 48 in quadrant IV, a first whale 50 in quadrant II, and a second whale 52 in quadrant III. As described above for the example reference mark 32 of FIG. 1, the pictures shown in this example are rotationally symmetric with respect to the midpoint P of the grid 20. Given this description, those of ordinary skill in the art will be able to select appropriate reference marks to meet their particular needs.

The symmetry of the bears 46, 48 and whales 50, 52 visually links locations of the blank answer spaces 28 in quadrant I to corresponding symmetric locations of blank answer spaces 28 in quadrant IV and locations in quadrant II to corresponding symmetric locations in quadrant III. In the illustrated example, a user has already identified several spacers 53 and the corresponding symmetric spacers 53' by entering answers to puzzle clues. The user has identified spacer W in quadrant I after the answer "TUG" and now desires to identify a symmetric spacer W' in quadrant IV. The user associates the location of the spacer W with a portion of the picture of the first bear 46 (e.g. the right eye of the first bear 46). The user then visually determines the location of the symmetric spacer W' by looking for the right eye of the second bear 48 in quadrant IV. The right eye portions of the bears 46, 48 provide a visual relationship between the corresponding symmetric spacers W and W'.

In one example, this feature may be beneficial in eliminating at least some confusion and complexity in locating symmetrically located answer spaces and spacers when the user desires to locate answer spaces and spacers near a middle portion 54 of the grid 20 (e.g. not at a perimeter 56 of the grid 20) as the user progresses through the set of puzzle clues. Thus, the reference mark 32 facilitates solving or composing a word game puzzle.

Figure 4:
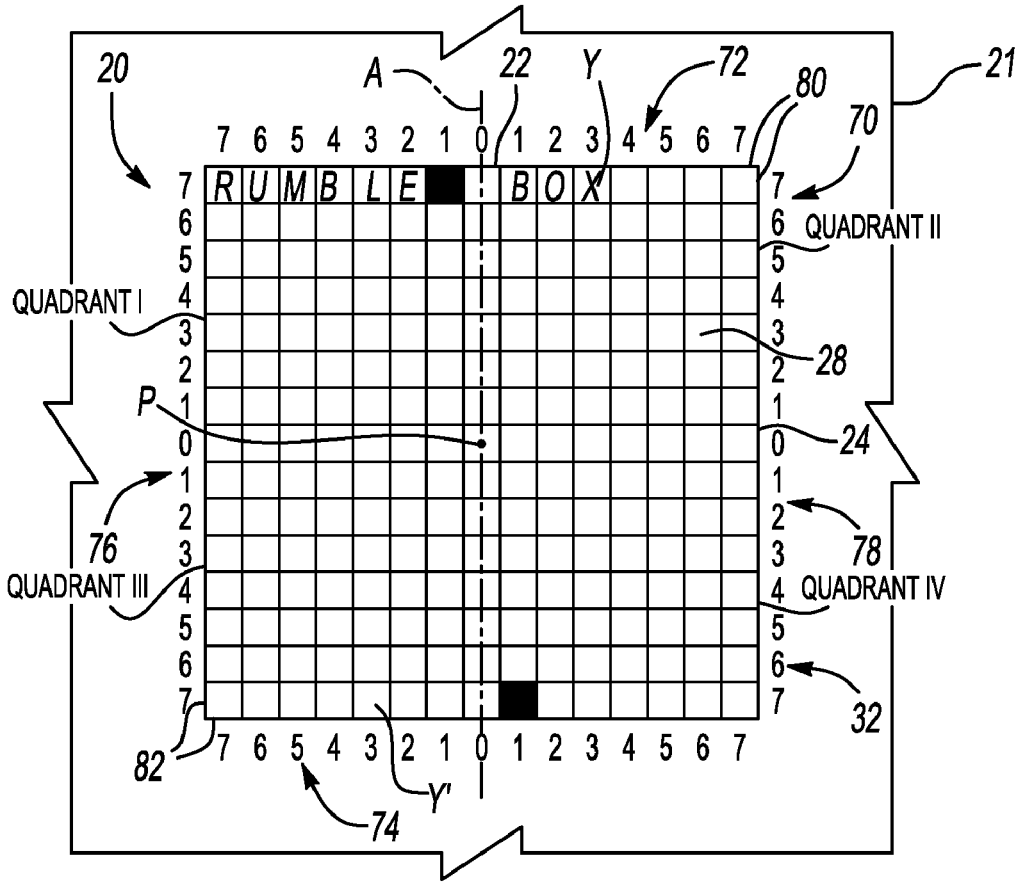
FIG. 4 illustrates a schematic view of a third embodiment of an example word puzzle grid having symmetric coordinates.

FIG. 4 shows another embodiment of the grid 20 including a reference mark 32 having a symmetric coordinate system 70 for associating locations of the blank answer spaces 28 in quadrant I to corresponding symmetric locations of blank answer spaces 28 in quadrant IV and locations in quadrant II to corresponding symmetric locations in quadrant III. The example of FIG. 3 does not include a pattern 34, however, the coordinate system 70 may be used in combination with a pattern 34 to further facilitate locating symmetric spaces.

The coordinate system 70 includes top and bottom horizontal coordinates 72,74 and left and right vertical coordinates 76, 78. In the illustrated example, the coordinates include numbers, although letters, symbols, and combinations thereof could also be used. The top and bottom horizontal coordinates 72 and 74 include the number "0" designating the vertical center column 22 and numbers "1" through "7" designating columns of the quadrants. The left and right vertical coordinates 76 and 78 include the number "0" designating the horizontal center row 24 and numbers "1" through "7" designating rows in each quadrant.

In one example, the numbers "1" through "7" across the top of quadrant I, down the left side of quadrant I, across the bottom of quadrant IV, up the right side of quadrant IV are colored red. The numbers "1" through "7" across the top of quadrant II, down the right side of quadrant II, across the bottom of quadrant III, up the left side of quadrant III are colored black. This feature provides the benefit of indicating which portions of the coordinate system 70 are to be used in each particular quadrant and provides a visual relationship between quadrants I and IV and quadrants II and III. That is, red and black colors indicate a symmetric relationship between quadrants I and IV and quadrants II and III, respectively.

The columns and rows of the grid 20 are numbered such that symmetrically located spaces have equal coordinates. In the illustrated example, a user has identified a spacer Y in quadrant II by entering several answers ("RUMBLE" and "BOX") and desires to find a symmetric spacer Y' in quadrant III. The spacer Y has a horizontal coordinate of "3" and a vertical coordinate of "7" using the portions of the coordinate system 70 that are adjacent to outer sides 80 of quadrant II. The symmetrically located spacer Y' in quadrant III has a horizontal coordinate of "3" and a vertical coordinate of "7" using the portions of the coordinate system 70 that are adjacent to outer sides 82 of quadrant III. The coordinates of spacer Y are therefore "3, 7" and the coordinates of the spacer Y' are therefore "3, 7," wherein the first coordinate is the horizontal coordinate. The coordinates of the spacer Y are equal to the coordinates of the symmetrically located spacer Y'. The equal coordinates between the spacers Y and Y' provide a visual relationship between corresponding symmetric locations in the grid 20.

The symmetric coordinate system 70 therefore provides the benefit of eliminating at least some confusion and complexity in locating symmetrically located answer spaces and spacers. Thus, the reference mark 32 facilitates solving or composing a word puzzle game.

Figure 5:
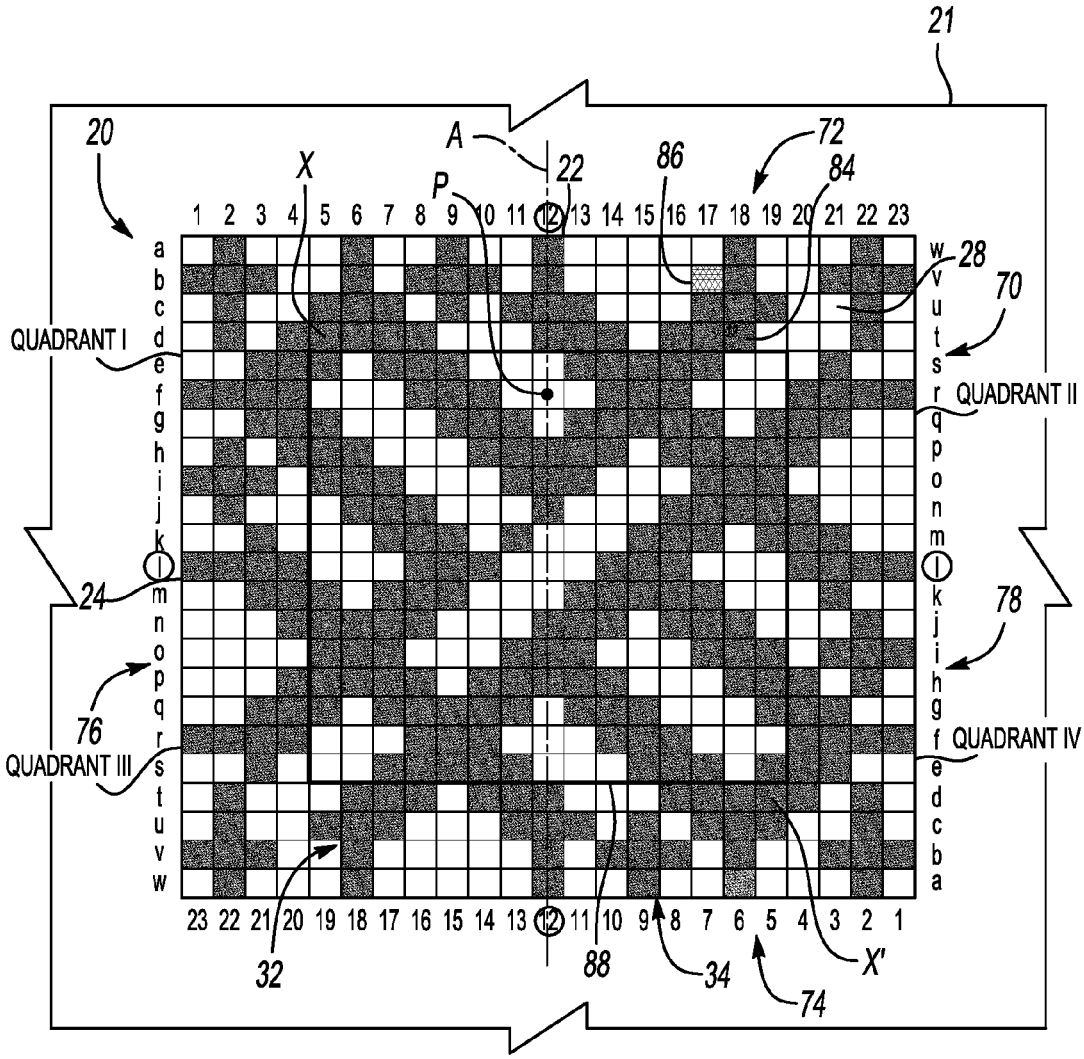
FIG. 5 illustrates a schematic view of another embodiment of an example word puzzle grid having a reference mark and symmetric coordinates.

FIG. 5 shows another example of the coordinate system 70 including numbered top and bottom horizontal coordinates 72 and 74, respectively. In the illustrated example, the top horizontal coordinates 72 are numbered "1" through "23" from left to right and the bottom horizontal coordinates 74 are numbered "23" through "1" from left to right. The "12" is circled to designate the vertical center column 22, although the "12" could alternatively be colored or include other designations to indicate the vertical center column 22. The left vertical coordinates 76 are lettered "a" through "w" from top to bottom and the right vertical coordinates 78 are lettered "w" through "a" from top to bottom. The letter "l" is circled to designate the horizontal center row 24. In one example, the symmetric spacers X and X' have identical coordinates (i.e. "5, d").

In the illustrated example, a blank answer space 84 in the grid 20 includes a number "12" to indicate to a user that the across and down answers associated with "12" are to be entered beginning in that square. In other examples, additional blank answer spaces 28 (but not more than the number of puzzle clues) may also include numbers to further aid the user.

In the illustrated example, the spacer 86 located at "17, b" is pre-designated instead of having the user reveal its location by entering answers. The pre-designated spacer 86 corresponds to a particular set of puzzle clues such that knowing the location may provide the benefit of helping the user solve the puzzle. In other examples, additional blank answer spaces 28 (but less than the total number of spacers for the particular set of puzzle clues) may be pre-designated spacers.

A grid 20, such as the 23×23 squares grid 20 shown in FIG. 5, provides the benefit of numerous, different-sized puzzles in a single gaming surface 21. A 23×23 grid 20 can be used to solve or compose 23×23 "diagramless" crossword puzzles. A 23×23 grid 20 can also be used to solve or compose smaller puzzles, for example a 17×17 puzzle or rectangular-shaped grids within the grid 20. The 23×23 grid 20 includes a 17×17 grid, as illustrated by the outline 88. In the example shown, the pattern 34 and coordinate system 70 can be used to locate symmetric spaces in the grid 20 for 23×23 puzzles, 17×17 puzzles, and puzzles of all sizes within the 23×23 grid 20.

Given this disclosure, one of ordinary skill in the art will recognize the versatility and applicability of the disclosure for his particular needs. Although a preferred embodiment of this invention has been disclosed, a worker of ordinary skill in this art would recognize that certain modifications would come within the scope of this invention. For that reason, the following claims should be studied to determine the true scope and content of this invention.

I claim:

1. A word puzzle game comprising:

a diagramless crossword puzzle grid of blank answer spaces for entering answers to crossword puzzle clues the diagramless crossword puzzle grid being free of any black spacer squares within the grid that are between the blank answer spaces; and a reference image including portions within each of four quadrants of the grid for facilitating visual identification of symmetric locations in the grid, the reference image being rotationally symmetric about a midpoint of the grid such that the image is unchanged if rotated 180° relative to the midpoint, each portion of the image within a given square and quadrant thereby corresponding to another, identical portion of the image in another square located in another quadrant at a rotationally symmetric location in the grid such that the image can be used to visually relate symmetric grid locations for entering the answers in a symmetric fashion.

2. The word puzzle game as recited in claim 1, wherein each portion and the corresponding identical portion of the image are the same color.

3. The word puzzle game as recited in claim 1, wherein each portion and the corresponding identical portion of the image are the same shape.

4. The word puzzle game as recited in claim 1, further comprising symmetric coordinates outside of the grid that indicate grid coordinates for at least a portion of the blank answer spaces.

5. The word puzzle game as recited in claim 4, wherein the symmetric coordinates include at least one of a symbol, color, number, and letter.

6. The word puzzle game as recited in claim 1, including a gaming surface for displaying the diagramless grid of blank answer spaces and the reference image, the gaming surface comprising at least one of an electronic screen, erasable surface, inlaid surface, or printed surface.

* * * * *

UNITED STATES PATENT AND TRADEMARK OFFICE

CERTIFICATE OF CORRECTION

PATENT NO. : 7,591,469 B2
APPLICATION NO. : 10/591039
DATED : September 22, 2009
INVENTOR(S) : Robert Dowe It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 112 days.

Signed and Sealed this

Twenty-first Day of September, 2010

David J. Kappos

David J. Kappos
*Director of the United States Patent and Trademark Office*